US005651758A

United States Patent [19]

Cervantes

[11] Patent Number: 5,651,758

[45] Date of Patent: Jul. 29, 1997

[54] DUMBBELL SUPPORTER

[76] Inventor: Juan C. Cervantes, 11411 SW. 35th La., Miami, Fla. 33165

[21] Appl. No.: 695,740

[22] Filed: Jul. 12, 1996

[51] Int. Cl.[6] ..... A63B 21/072

[52] U.S. Cl. ..... 482/93; 482/108

[58] Field of Search ..... 482/93, 50, 106–109, 482/94, 104; 232/100, 237, 210; 24/517

[56] References Cited

U.S. PATENT DOCUMENTS 1,895,746 1/1933 Bates ..... 24/517

4,231,569 11/1980 Rae ..... 482/108

*Primary Examiner*—Stephen R. Crow

*Assistant Examiner*—John Mulcahy

*Attorney, Agent, or Firm*—J. Sanchelima

[57] ABSTRACT

A device for supporting dumbbells that have a bar with two ends and a weight mounted on each end. The device is used to suspend the dumbbell from a hook mounted at the top of a vertically extending post. The device includes two parallel elongated arm members that have each first and second sends with a connecting member mounted at one end of each. This connecting member is received by a hook at the uppermost end of a vertically extending post. The second ends form bays that receive the bar of the dumbbell, and a locking assembly is provided to keep the bar in place.

5 Claims, 2 Drawing Sheets

DUMBBELL SUPPORTER

BACKGROUND OF THE INVENTION

1. Field of the Invention

The present invention relates to a dumbbell supporter, and more particularly, to the type that is removably mounted to a dumbbell.

2. Description of the Related Art

A dumbbell user typically requires a helper to "spot" him while lifting heavy weights. The helper makes sure that the dumbbells do not slip of the user's hands typically when his strength is dangerously diminished at the end of the exercise when attempting to place the dumbbell on the floor. Many times, the weight required for exercising is considerably greater than the weight that a user can lift from the floor when he or she is lying down on a bench thus requiring that a helper aids in the lifting of the dumbbells.

The present invention provides a dumbbell holder or supporter that permits a user to removably mount the dumbbell to a hook typically found at the end of a vertically mounted bar in order to avoid having to lift it from the floor. The dumbbell supporter also includes a spacer member that keeps the dumbbell separated from said bar thereby permitting a user to insert his or her hand between the dumbbell shaft and the bar. A lock mechanism keeps the dumbbell shaft releasably in place thus assuring that it will not slip off the supporter.

SUMMARY OF THE INVENTION

It is one of the main objects of the present invention to provide a dumbbell supporter that permits a user to exercise safely without assistance.

It is another object of this invention to provide a dumbbell supporter that can be mounted on a hook at the end of a vertically mounted bar adjacent to one end of the bench where a user lies down to exercise.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
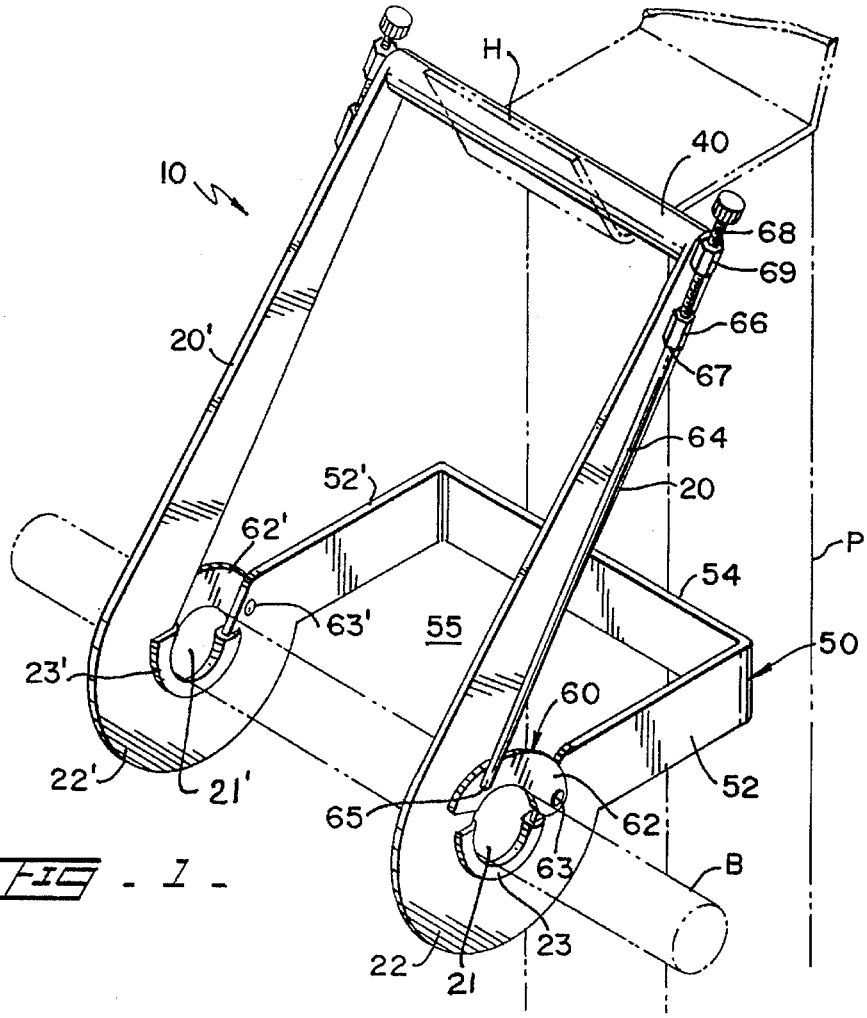
FIG. 1 is an isometric view of the present invention mounted to the hook of a bar.

Referring now to the drawings, where the present invention is generally referred to with numeral 10, it can be observed that it basically includes elongated arms 20 and 20' that at one end are joined with connecting member 40 that is received by hook H, typically found at the top of vertically disposed support post P adjacent to exercise benches (not shown). The other end of arms 20 and 20' have arcuated terminations 22 and 22' that extend approximately 270 degrees forming bays 21 and 21'. Dumbbell supporter 10 is mounted to bar B and between weight members W.

Figure 2:
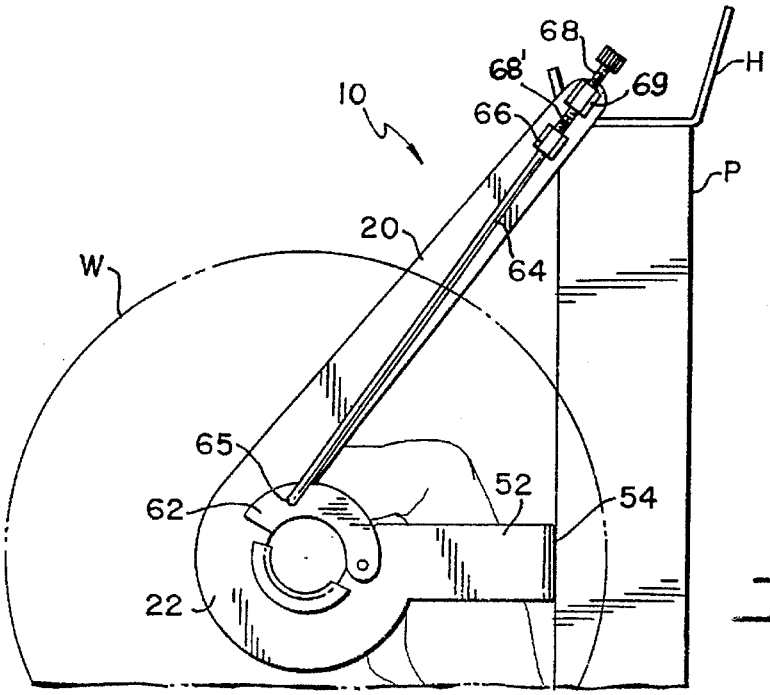
FIG. 2 is a side elevational view of the dumbbell supporter shown in the previous figure.

Spacer assembly 50 is preferably integrally mounted to arcuated terminations 22 and 22' in order to keep the latter at a spaced apart relationship with respect to post P. Spacer assembly 50 includes spacer members 52 and 52' that are mounted at one of their ends to arcuated terminations 22 and 22' and their other ends connected to stopper member 54. The spacer members 52 and 52' extend from the arcuated terminations 22 and 22' at an angle of between 30 and 90 degrees with respect to the plane defined by the elongated arms 20 and 20'. Stopper member 54 rests against post P when supporter 10 is suspended at the top of post P. Spacer members 52 and 52' and stopper member 54 define space 55 for a user to insert his hand through and grab bar B, as best seen in FIGS. 1 and 2. Dumbbell supporter 10 is designed to be used permanently or removably mounted to bar B. While a user is exercising with bar B and weight W, dumbbell supporter 10 stays on. Once a user ends his or her exercises, dumbbell supporter 10 is easily placed back on hook H by connecting member 40 keeping dumbbell weight W suspended.

Figure 3:
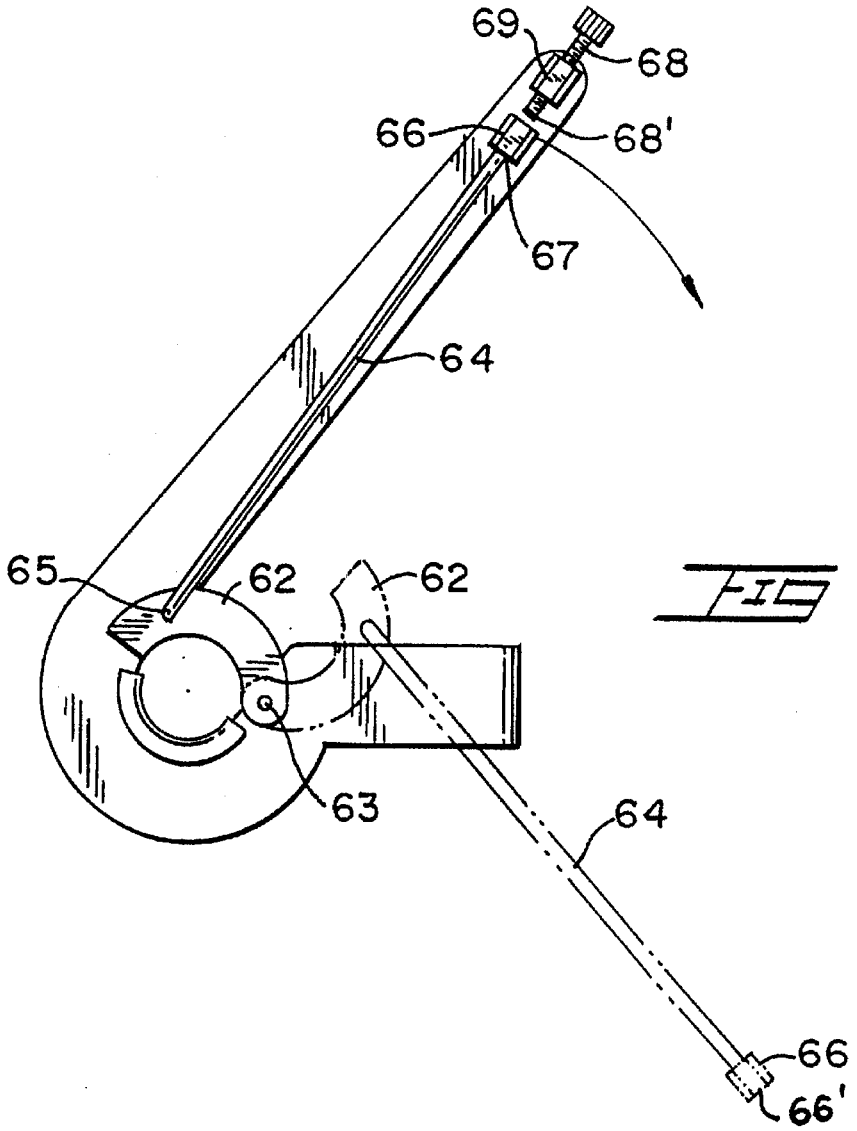
FIG. 3 illustrates a side elevational view of this invention showing the movement of the locking mechanism.

Locking mechanism 60 includes pivotally mounted latch members 62 and 62' that also have an arcuated shape to cooperatively embrace dumbbell bar B. Elongated bar 64 (and a similar bar for arm 20') is rigidly mounted at one end 65 to the distal end of latch member 62 so that when the latter embraces bar B, the other end 67 of bar 64 is coaxially aligned with threaded holder 69. Socket member 66 is rigidly mounted at end 67 of bar 64. When screw 68 is advanced through threaded holder 69, its pointed end 68' is received within socket member 66, that includes central threaded opening 66', thereby securing it in place and consequently securely grabbing bar B. Cushion members 23 and 23' are designed to help keeping in place bar B avoiding any possible movement and are made out of a rubber, porous material or equivalent. Once the exercise is ended, a user unscrews screw 68 until socket 66 is free and bar 64 with latch 62 releases bar B. Bar B can be removed by pivoting latch members 62 and 62' with respective bars 64 and 64' (not shown) about pivoting pins 63 and 63' and away from arms 20 and 20', as best seen in FIG. 3.

The invention is made out of a light material so that the ratio of its weight in relation to the weight of the dumbbell is minimized.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device for supporting a dumbbell having a bar with two ends and a weight member mounted on each of said ends, said device to be used to suspend said dumbbell from a vertically extending post having a hook at its uppermost end, said device comprising:

A) first and second elongated arm members having each first and second ends and a connecting member rigidly connecting said first ends, and said second ends forming arcuated first and second terminations defining first and second bays of cooperative dimensions to receive said bar, and said first and second elongated arm members being kept at a spaced apart and parallel relationship with respect to each other and said device further includes first and second spacer members having third and fourth ends each, said third ends extending from said first and second terminations, at an angle with respect to the plane defined by said first and second elongated arm members, between 30 and 90 degrees and further including a stopper member rigidly connecting said fourth ends; and B) bar locking means having a first and second latch members having fifth and sixth ends and said fifth ends being pivotally mounted to said first and second terminations, respectively, and further including first and second elongated bar members including seventh and eighth ends and said seventh ends being rigidly connected to said sixth ends, said eighth ends including each a socket member, and said locking means further including first and second protrusions with threaded through holes each mounted at said first ends and being longitudinally aligned with said first and second elongated members and further including first and second screw means having each ninth and tenth ends, said ninth ends including means for rotating said first and second screw means and advancing said first and second screw means through said threaded through holes so that said tenth ends are brought inside said socket member so that said dumbbells are firmly and removably held by said device.

2. The device set forth in claim 1 wherein said socket members include each a central threaded opening that cooperatively receive said tenth ends.

3. The device set forth in claim 2 further including first and second cushion members mounted over said first and second bays thereby enhancing the engagement with said bar.

4. The device set forth in claim 3 wherein said first and second spacer members have a cooperative and sufficient dimension to permit a user to hold said bar by placing his or her hand between said stopper member, first and second spacer members.

5. The device set forth in claim 4 that is made out of a light material so that the ratio of its weight in relation to the weight of said dumbbell is minimized.

* * * * *